United States Patent [19]

Kolle

[11] Patent Number: 4,669,783

[45] Date of Patent: Jun. 2, 1987

[54] PROCESS AND APPARATUS FOR FRAGMENTING ROCK AND LIKE MATERIAL USING EXPLOSION-FREE HIGH PRESSURE SHOCK WAVES

[75] Inventor: Jack J. Kolle, Seattle, Wash.

[73] Assignee: Flow Industries, Inc., Kent, Wash.

[21] Appl. No.: 813,823

[22] Filed: Dec. 27, 1985

[51] Int. Cl.[4] ..... E21C 37/12

[52] U.S. Cl. ..... 299/16; 299/20; 102/313; 102/328

[58] Field of Search ..... 299/16, 21, 13, 20; 175/67; 166/177, 249, 308, 63; 102/313, 328

[56] References Cited

U.S. PATENT DOCUMENTS

| | | | |
|---|---|---|---|
| 1,569,226 | 1/1926 | Hemholtz et al. | 102/313 |
| 2,024,247 | 12/1935 | Officer | 102/313 |
| 2,058,099 | 10/1936 | Osgood | 102/328 |
| 2,083,706 | 6/1937 | Harris | 102/313 |
| 3,202,108 | 8/1965 | Fly et al. | 166/308 |
| 3,302,720 | 2/1967 | Brandon | 166/249 |
| 4,195,885 | 4/1980 | Lavon | 299/1 |
| 4,474,409 | 10/1984 | Trevits et al. | 166/308 X |

*Primary Examiner*—Stephen J. Novosad
*Assistant Examiner*—Michael A. Goodwin
*Attorney, Agent, or Firm*—Flehr, Hohbach, Test, Albritton & Herbert

[57] ABSTRACT

A technique for fragmenting rock or other relatively hard and/or compact material without the use of explosives is disclosed herein. In accordance with this technique, an elongated, blind opening is provided in the rock or other material to be fragmented and a pulse of water having a relatively high peak pressure and a relatively rapid rise time is directed into the elongated opening without the use of explosives to produce the pulse, whereby to produce a shock wave in the rock or other material sufficient to fragment it. In an actual embodiment, this explosion free pulse of water has a peak pressure of about 80,000 psi and a rise time of about one millisecond.

19 Claims, 3 Drawing Figures

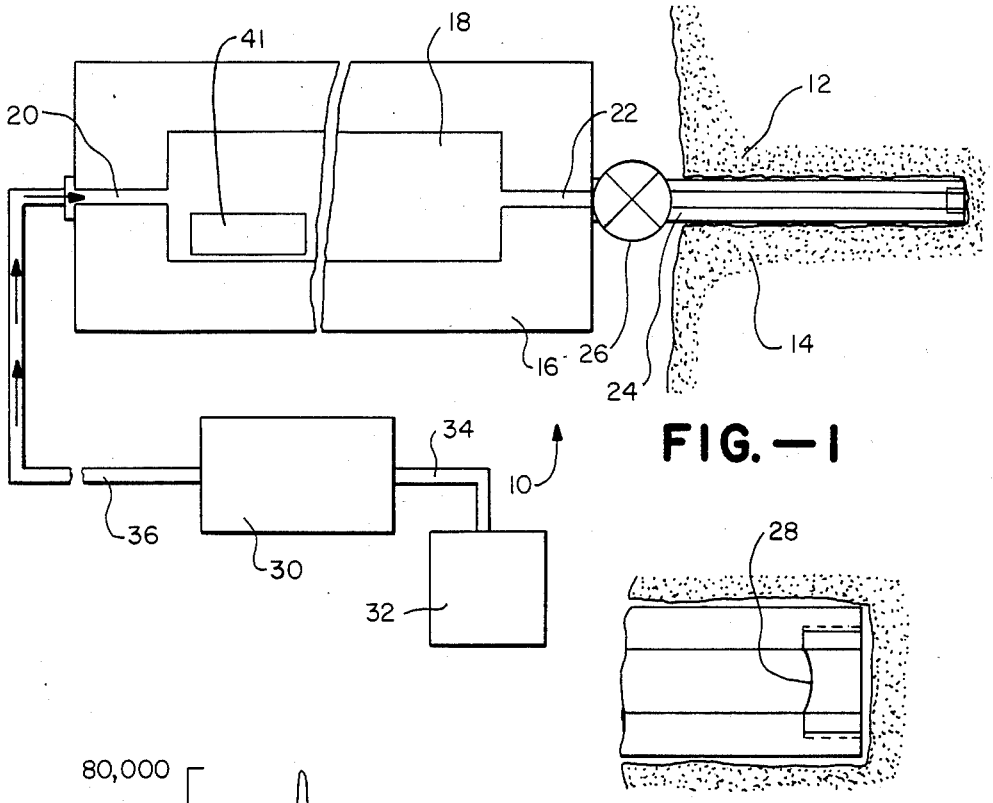
FIG.—1
FIG.—2
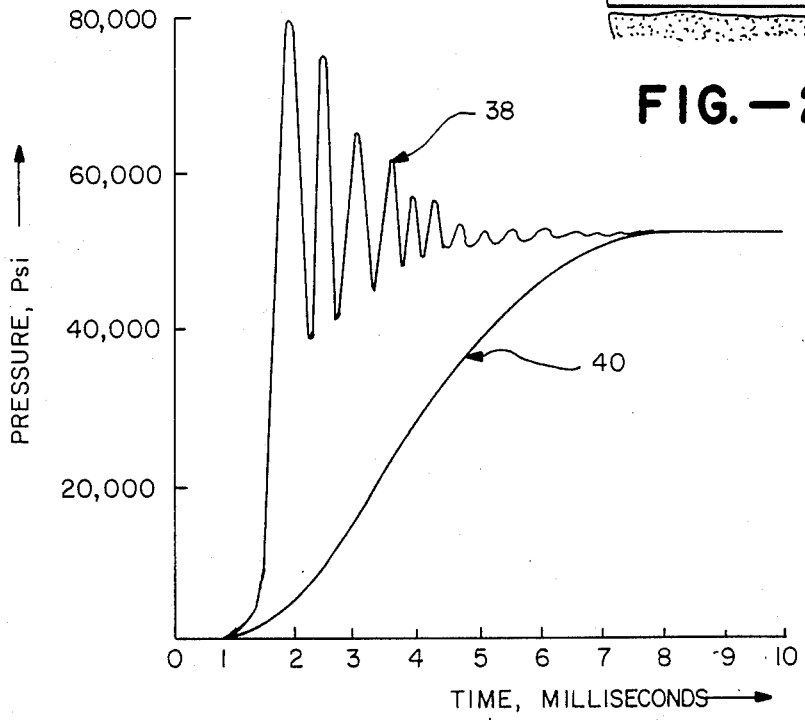
FIG.—3

PROCESS AND APPARATUS FOR FRAGMENTING ROCK AND LIKE MATERIAL USING EXPLOSION-FREE HIGH PRESSURE SHOCK WAVES

This invention was made with Government support under contract FO4704-85-C-0165 awarded by the United States Air Force. The U.S. Government has certain rights in this invention.

The present invention relates generally to techniques for fragmenting rock and other relatively hard and/or compact material and more particularly to a technique for fragmenting rocks and like material by means of ultra-high pressure shock waves produced without the use of explosives.

There are a number of known techniques for fracturing rock by means of shock waves. One such technique utilizes a pump of some sort for directing the pulsed liquid jet into a predrilled hole in the rock or other such material. A technique of this general type is described in U.S. Pat. No. 4,123,108 assigned to Atlas Copco AK Tiebolag of Sweden. The Atlas Copco AK Tiebolag device fires a 1.8 liter slug of water into the predrilled hole at an approximate peak pressure of 6,000 psi utilizing a piston type gas/water accumulator. Tools of this type do not effectively fragment confined rock because they do not provide sufficiently high pressures within short enough pressure rise times. In addition, it typically takes a relatively large period of time, for example on the order of 60 seconds, to recharge the device between shots.

One way to provide substantially higher pressure slugs of water or other liquid into the predrilled hole of rock or other such material is to utilize known blasting techniques based on explosives, as described, for example, in U.S. Pat. No. 4,449,754. However, this type of approach is objectionable on several grounds. First, explosive charges generally result in secondary pressures associated with expanding gases from the explosive, thereby possibly ejecting the fragmenting rock into the surroundings. Second, these explosions typically give off toxic fumes.

Another technique to produce a liquid or gaseous pressure pulse and specifically a technique which is explosion-free is to place a pressurized cartridge having a rupture seal in a predrilled opening in rock or other such material to be fragmented and back-filling the opening behind the cartridge. Examples of this approach are illustrated in U.S. Pat. Nos. 1,569,226 (HELMHOLTZ); 1,920,094 (MARTIN); and 2,058,099 (OSGOOD). In HELMHOLTZ, the cartridge is pressurized to a level just below the rupture pressure of its closure disk and the pressurized cartridge is located in a predrilled and back-filled blind hole in a body of coal or other material. At the same time, the cartridge is connected by means of a conduit to a remotely positioned pump which then increases the internal pressure of the cartridge sufficient to rupture its closure. The pressure involved in the HELMHOLTZ device is on the order of 5,000 psi, that is, on the same order as the pressures associated with the Atlas Copco AK Tiebolag device described above. The OSGOOD approach is similar to HELMHOLTZ but does not recite any particular pressure values. MARTIN on the other hand does not rely on a separate pump but rather initially fills its container or cartridge with solid carbon dioxide which eventually melts and expands, increasing the internal pressure of the cartridge sufficient to rupture its seal. There is no discussion in the MARTIN patent of relatively high pressure values. There are a number of draw backs in the approaches described in the HELMHOLTZ, MARTIN and OSGOOD patents just discussed. First, each approach requires that its predrilled hole be back-filled in order to provide sufficient inertial confinement means behind the cartridge when it ruptures. This is time consuming and requires a relatively long opening. Moreover, if the blast resulting from the rupture of the container is to be of any reasonably duration at high pressures, the container or cartridge would have to be relatively large and therefore the predrilled opening itself would have to be relatively large.

In view of the foregoing, it is one object of the present invention to provide a technique for fragmenting rock or like material by means of ultra-high pressure shock waves, without the use of explosives.

Another object of the present invention is to provide an explosive free technique for fragmenting rock or like material by producing in an uncomplicated way an ultra-high pressure shock wave which has a rapid rise time and a relatively long duration.

Still another object of the present invention is to provide an explosive free technique of the last mentioned type in which the shock wave is produced in a predrilled hole in rock or other such material without having to back-fill the predrilled hole and without having to make it very large in cross-section.

As will be described in more detail hereinafter, the technique discussed briefly immediately above is designed to direct a single initial pulse of water into a predrilled opening within the rock or other such material to be fragmented and this initial pulse, without the use of explosives, is intended to have an ultra-high peak pressure and a rapid rise time.

The specific apparatus disclosed herein to accomplish this includes means defining a chamber for storing water under pressure and also an inlet into and outlet from the chamber. There is also provided a rigid straight conveyance tube substantially smaller in cross-section than and connected at one end to the chamber defining means in fluid communication with the chamber outlet. This tube is configured to withstand the same internal water pressure as the chamber and has an end section including a free end adapted to be positioned within an elongated, predrilled blind opening in the rock or other material to be fragmented. The blind opening is preferably only slightly larger in cross-section than the cross-section of the tube but substantially smaller than the cross-section of the chamber defining means. A rupture disk is connected across and closes the free end of the tube and is designed to rupture at a predetermined pressure below the maximum internal water pressure capable of being withstood by the chamber defining means and tube. Means are provided for pressurizing the chamber and tube with water to the rupture pressure of the rupture disk when the end section of the tube including the disk is positioned within the predrilled blind opening, whereby to rupture the disk, this, in turn, causes the pressurized water within the chamber and tube to escape through the rupture disk for producing a sufficiently large shock wave in the rock or other material in order to cause the latter to fragment.

The fragmenting technique just disclosed briefly will be described in more detail in conjunction with the drawing wherein:

FIG. 1 is a diagrammatic illustration of an overall apparatus for carrying out the technique in accordance with the present invention;

FIG. 2 is an enlarged view of a part of the apparatus of FIG. 1; and

FIG. 3 is a graphic analysis of different pressure pulses resulting from the apparatus illustrated in FIG. 1.

Turning now to the drawings, attention is first directed to FIG. 1 which diagrammatically illustrates an apparatus designed in accordance with the present invention for fragmenting rock or other such relatively hard and/or compact material. The apparatus is generally indicated at 10 and the rock or other material (hereinafter merely referred to as rock) is shown at 12. As illustrated in FIG. 1, an elongated straight blind opening 14 has been predrilled into rock 12. As will be seen hereinafter, it is the primary function of apparatus 10 to direct into blind opening 14 an initial pulse of water having an ultra-high peak pressure, a rapid rise time and a relatively long duration, whereby to produce a sufficiently large shock wave in the rock in order to fragment the latter. As will also be seen, this is accomplished without the use of explosives.

Overall apparatus 10 includes a pressure vessel 16 defining an internal pressure chamber 18 and including an inlet 20 into and an outlet 22 out of the chamber. As will be seen hereinafter, vessel 16 functions to store hydraulic energy at ultra-high pressures, for example pressures which exceed 55,000 psi. In an actual working embodiment, the vessel, is an attenuator, manufactured by Flow Industries. This vessel has a chamber volume of 143 $in^3$ and, as will be seen below, is capable of being charged to 55,000 psi within one second. Still referring to FIG. 1, apparatus 10 is shown including a rigid conveyance tube 24 which is configured to withstand the same internal water pressure as chamber 18 and which is suitably, connected with vessel 16 such that its interior is in fluid communication with outlet 22 and therefore with chamber 18. A valve 26 moveable between an opened position and a closed position may be located at outlet 22 in order to open and close fluid communication between chamber 18 and the interior of tube 24. As will be seen below, while such a valve is preferable, it is not necessary to all aspects of the invention.

From FIG. 1 it can be seen that tube 24 is substantially smaller in cross-section than the pressure vessel 16 and extends in a straight line from one end of the latter. For reasons to be discussed below, it is preferable if the tube is only slightly longer than the predrilled opening 14 so that vessel 16 is located in relatively close proximity to and in direct alignment with the opening. Also, the cross-section of opening 14 should be only sufficiently larger than the outside diameter of tube 24 so as to allow the latter to readily slide within the opening.

Referring to FIG. 2, apparatus 10 is shown including a rupture disk generally indicated at 28 suitably mounted to and across the free end of tube 24. This disk is designed to rupture at a predetermined pressure below the maximum internal water pressure capable of being withstood by vessel 16 and tube 24. In a preferred embodiment, the disk is designed to rupture at an ultra-high predetermined pressure of between 10,000 and 100,000 psi, specifically about 55,000 psi in an actual working embodiment. The rupture disk specifically used in this actual working embodiment is a rupture disk, part no. CS-9600, manufactured by Autoclave Engineering. In addition to the components thus far described, overall apparatus 10 includes a suitable hydraulic pump generally indicated at 30 and connected in line between a supply of water 32 and the inlet 20 of vessel 16 by suitable plumbing 34 and 36 in order to pressurize vessel chamber 18 with water. Pump 30 may be of any suitable type capable of pressurizing chamber 18 to the ultra-high levels discussed above. In an actual working embodiment, the pump is an Intensifier, manufactured by Flow Industries and is capable of pressurizing vessel chamber 18 to 55,000 psi within one second whether or not the pump is positioned relatively close to vessel 16 or, as illustrated in FIG. 1, relatively far away, for example, 1,000 feet. While the present invention is practice advantageously using water to form the ultimately produced pressure pulses, there may be circumstances where water-gas mixtures, water solutions or other liquids might be suitable. It may also be desirable to include a compressable body 41 such as a gas or fluid filled bladder or any solid material having a bulk compressability greater than that of water inside the pressure vessel chamber 18 in order to increase the amount of energy stored in the vessel 16. The scope of the present invention is intended to cover such circumstances.

Having described overall apparatus 10, attention is now directed to the way in which it operates to fragment rock 12. As shown in FIG. 1, a section of tube 24 including its free end and rupture disk 28 are positioned within predrilled opening 14 so that the free end of the tube is in close confronting relationship with the end of the opening, as best illustrated in FIG. 2. Note that the pressure vessel 16 is positioned in alignment with and in close proximity to the predrilled opening. In accordance with a preferred method of operating apparatus 10, the pressure vessel 16 and tube 24 are initially positioned in the manner shown in FIG. 1 before the storage vessel is pressurized and with valve 26 in its opened position. Thereafter, while the valve 26 remains opened, chamber 18 is pressurized by means of pump 30 to a pressure sufficiently high to cause disk 28 to rupture. This, in turn, causes the water within the chamber and tube 24 to escape through the ruptured disk for producing a shock wave in rock 12. The overall apparatus is designed so that this shock wave is sufficiently large to fragment the rock.

As indicated above, in an actual working embodiment, disk 28 is designed to rupture at an ultra-high pressure of approximately 55,000 psi. The waveform associated with this burst in pressure is illustrated in FIG. 3 at 38. Note that the rise time during which the waveform reaches its peak pressure is on the order of one millisecond and that the peak pressure is substantially greater than the 55,000 psi rating. While not shown, once chamber 18 is charged to the rupture pressure of the disk causing the latter to rupture, the storage vessel will sustain the resultant pulse for a relatively long period of time, specifically on the order of 100 milliseconds. One reason for this is that the chamber 18 can be designed to be relatively large compared to predrilled opening 14. Another reason for this is that a compressable body 41 can be included in the pressure vessel chamber 18 further increasing the length of time over which the pressure pulse will be sustained. This is in contrast to the cartridges of the HELMHOLTZ, MARTIN or OSGOOD patents, which cartridges are disposed directly into the predrilled opening, thereby requiring that either they be relatively small in cross-section or the associated openings be relatively large. In addition, because the vessel 16 can be made relatively large and because it can be positioned in line with tube 24 in close proximity to blind opening 14, when the disk 28 ruptures, the vessel itself will serve as an inertial confinement means without having to back fill the opening, as in the HELMHOLTZ, MARTIN and OSGOOD patents and without having to use other elaborate types of inertial arrangements, as for example in previously recited U.S. Pat. No. 4,449,754.

As indicated above, in its preferred embodiment, overall apparatus 10 produces waveform 38 by charging chamber 18 while valve 26 is in its opened position. This means that the pressure vessel 16 and tube 24 must first be placed in position, as illustrated in FIG. 1. As an alternative, the chamber could be fully pressurized with the valve closed, for example at a remote location, and then moved into its operating position, at which time valve 26 could be opened or it could be partially pressurized at a remote location. In any of these cases, once the pulse 38 is produced by rupturing disk 28, a second identical pulse cannot be produced without replacing the rupture disk with a new one. However, in accordance with a preferred method of operating apparatus 10, immediately after pulse 38 is produced, chamber 18 is recharged to its maximum pressure, for example the previously recited 55,000 psi, with valve 26 in its opened position. This results in a follow up pulse having that peak pressure but a substantially slower rise time than initial pulse 38, as exemplified in FIG. 3 by means of pulse 40. Since chamber 18 is capable of being charged to 55,000 psi in one second, in the actual embodiment, pulse 40 can be provided very close behind pulse 38, and, in fact, subsequent pulses 40 (not shown) can be successively provided with delay times only on the order of one second. While these secondary pulses by themselves might not fracture rock 12, once the rock is fractured by initial pulse 38, they are quite helpful in further fracturing the rock. It is also possible to use the valve 26 to provide the initial pressure pulse 40. Pulse 40 will not fragment the rock as effectively as pulse 38 but will produce a single fracture which may be desirable in some circumstances. It may be possible to effectively excavate some types of rock by using the valve 26 alone for producing multiple pulses.

What is claimed is:

1. An apparatus for fragmenting rock or other relatively hard and/or compact material having a previously drilled or otherwise provided elongated blind opening therein, comprising:

(a) means defining a chamber for storing water under pressure, an inlet into said chamber and an outlet from said chamber;

(b) a rigid, straight conveyance tube substantially smaller in cross-section than and connected at one end to said chamber defining means, in fluid communication with said chamber outlet and configured to withstand the same internal water pressure as said chamber, said tube having an end section including a free end adapted to be positioned within said elongated blind opening of said rock or other material, said blind opening of said rock having a cross-section which is slightly larger than the cross-section of the tube but substantially smaller than the cross-section of said chamber defining means;

(c) a rupture disk connected across and closing said free end of said tube, said disk being designed to rupture at a predetermined pressure below the maximum internal water pressure capable of being withstood by said chamber defining means and said tube;

(d) means for pressurizing said chamber and tube with water to the rupture pressure of said rupture disk when the end section of said tube including said disk is positioned within said blind opening, whereby to rupture said disk and cause the pressurized water within said chamber and tube to escape through the ruptured disk for producing a sufficiently large shock wave in said rock or other material in order to fragment the latter; and (e) said chamber defining means being positioned adjacent to and directly behind said straight tube so that, by providing an elongated blind opening in said rock or other material which is sufficiently deep to receive substantially all of said tube, said chamber defining means can be located in close proximity to said blind opening directly behind said tube and thereby serve as an inertial confinement means for the tube when said shock wave is produced.

2. An apparatus according to claim 1 wherein said disk is designed to rupture at a predetermined pressure between about 10,000 and 100,000 psi.

3. An apparatus according to claim 2 wherein said predetermined rupture pressure is 55,000 psi.

4. An apparatus according to claim 1 wherein said chamber defining means is a pressure vessel defining said chamber and including said inlet and outlet.

5. An apparatus according to claim 1 wherein said chamber and tube pressurizing means includes a high pressure pump having an input and output means for connecting the input of said pump to a supply of water and means for connecting the output of said pump in fluid communication with said chamber inlet.

6. An apparatus according to claim 5 wherein said disk is designed to rupture at a predetermined pressure between about 10,000 and 100,000 psi and wherein said pump is capable of pressurizing said chamber and tube to said predetermined pressure within at most about one second.

7. An apparatus according to claim 1 including valve means movable between a first position for closing fluid communication between said chamber and the free end of said tube and a second position for opening fluid communication between said chamber and the free end of said tube.

8. An apparatus according to claim 1 including a compressable body having a bulk compressability greater than that of water disposed within said chamber.

9. An apparatus for fragmenting rock or other relatively hard and/or compact material having a previously drilled or otherwise provided elongated blind opening therein, comprising:

(a) a pressure vessel defining a chamber for storing liquid under pressure exceeding 55,000 psi, said vessel including both an inlet into and an outlet from said chamber;

(b) a rigid, straight conveyance tube substantially smaller in cross-section than said vessel and capable of withstanding internal pressures in excess of 55,000 psi, said tube being fixedly connected at one end to said vessel in fluid communication with said chamber outlet, said tube having an end section including a free end adapted to be positioned within said elongated blind opening in said rock or other material, said elongated blind opening having a cross-section which is slightly larger than the cross-section of the tube but substantially smaller than the cross section of said pressure vessel;

(c) a rupture disk connected across and closing said free end of said tube, said disk being designed to rupture at a pressure of approximately 55,000 psi;

(d) a pump arrangement for pressurizing said chamber and tube with liquid to the rupture pressure of said disk within a time period of at most approximately one second when the end section of said tube including said rupture disk is positioned within said blind opening, whereby to rupture said disk and cause the pressurized liquid in said chamber and tube to escape through the rupture disk for producing a sufficiently large shock in said rock or other material in order to fragment the latter; and (e) said chamber defining vessel being positioned adjacent to and directly behind said straight tube so that, by providing an elongated blind opening in said rock or other material which is sufficiently deep to receive substantially all of said tube, said chamber defining vessel can be located in close proximity to said blind opening directly behind said tube and thereby serve as an inertial confinement means for the tube when said shock wave is produced.

10. An apparatus according to claim 9 including valve means movable between a first position for closing fluid communication between said chamber and the free end of said tube and a second position for opening fluid communication betwen said chamber and the free end of said tube.

11. A method of fragmenting rock or other relatively hard and/or compact material, comprising the steps of:

(a) providing an arrangement including (i) means defining a chamber for storing water under pressure, an inlet into said chamber and an outlet from said chamber, (ii) a rigid, straight conveyance tube substantially smaller in cross section than and connected at one end to said chamber defining means in fluid communication with said chamber outlet and configured to withstand the same internal water pressure as said chamber, said tube having an end section including a free end adapted to be positioned within an elongated blind opening of said rock or other material, said elongated blind opening having a cross-section which is slightly larger than the cross-section of the tube but substantially smaller than the cross section of said chamber defining means, (iii) a rupture disk connected across and closing said free end of said tube, said disk being designed to rupture at a predetermined pressure below the maximum internal water pressure capable of being withstood by said chamber defining means and said tube, and (iv) said chamber defining means being positioned adjacent to and directly behind said straight tube so that, by providing an elongated blind opening in said rock or other material which is sufficiently deep to receive substantially all of said tube, said chamber defining means can be located in close proximity to said blind opening directly behind said tube and thereby serve as an inertial confinement means for the tube when said shock wave is produced;

(b) providing said blind opening in said rock or other material sufficiently deep to receive substantially all of said tube;

(c) positioning substantially all of said tube including its end section and rupture disk in said blind opening, whereby said chamber defining means is thereby located adjacent said blind opening directly behind said tube; and (d) pressurizing said chamber and tube to the rupture pressure of said disk, whereby to rupture said disk and cause the pressurized water within said chamber end tube to escape through the ruptured disk for producing a sufficiently large shock wave in said rock or other material, in order to fragment said rock or other material, whereby said chamber defining means serves as inertial confinement means during production of said shock wave.

12. A method according to claim 11 wherein said disk is designed to rupture at a predetermined pressure between 10,000 and 100,000 psi.

13. A method according to claim 12 wherein said predetermined pressure is 55,000 psi.

14. A method according to claim 12 wherein said chamber and tubes are pressurized to the rupture pressure of said disk in at most about one second.

15. A method according to claim 12 wherein said arrangement includes valve means movable between a first position for closing fluid communication between said chamber and the free end of said tube and a second position for opening fluid communication between said chamber and the free end of said tube and wherein said valve means is maintained in said second position during said pressurization of said chamber and said tube.

16. A method according to claim 15 including the step of pressurizing said chamber and tube a second time after the rupture of said disk sufficiently fast to cause a pressurized pulse of water to pass out the free end of said tube and into said blind opening.

17. A method according to claim 11 wherein said chamber is pressurized by means of a pump located at a location remote from said blind opening.

18. A method according to claim 11 wherein said arrangement is provided with a compressable body having a bulk compressability greater than that of water disposed within its chamber.

19. An apparatus for fragmenting rock or other relatively hard and/or compact material having a previoulsy drilled or otherwise provided elongated blind opening therein, comprising:

means defining a chamber for storing water under pressure, an inlet into said chamber and an outlet from said chamber, said chamber defining means also including a compressible body having a bulk compressibility greater than that of water closed within said chamber;

(b) a rigid conveyance tube substantially smaller in cross-section than and connected at one end to said chamber defining means, in fluid communication with said chamber outlet and configured to withstand the same internal water pressure as said chamber, said tube having an end section including a fee end adapted to be positioned within said elongated blind opening of said rock or other material, said blind opening of said rock having a cross-section which is slightly larger than the cross-section of the tube but substantially smaller than the cross-section of said chamber defining means;

(c) a rupture disk connected across and closing said free end of said tube, said disk being designed to rupture at a predetermined pressure below the maximum internal water pressure capable of being withstood by said chamber defining means and said tube; and (d) means for pressurizing said chamber and tube with water to the rupture pressure of said rupture disk when the end section of said tube including said disk is positioned within said blind opening, whereby to rupture said disk and cause the pressurized water within said chamber and tube to escape through the ruptured disk for producing a sufficiently large shock wave in said rock or other material in order to fragment the latter.

* * * * *